United States Patent [19]

Kunst et al.

[11] 4,126,488

[45] Nov. 21, 1978

[54] BORIDING AGENT FOR BORIDING MASS PRODUCED PARTS OF FERROUS AND NON-FERROUS METALS

[75] Inventors: Helmut Kunst; Christian Scondo, both of Hanau, Germany

[73] Assignee: Deutsche Gold- und Silber-Scheideanstalt vormals Roessler, Frankfurt, Germany

[21] Appl. No.: 810,781

[22] Filed: Jun. 28, 1977

[30] Foreign Application Priority Data

Jul. 23, 1976 [DE] Fed. Rep. of Germany ..... 2633137

[51] Int. Cl.[2] ..... C23F 7/00

[52] U.S. Cl. ..... 148/6; 427/229; 427/253

[58] Field of Search ..... 427/229, 376 B, 253, 427/DIG. 5; 148/6, 6.3, 6.35

[56] References Cited

U.S. PATENT DOCUMENTS

| | | | |
|---|---|---|---|
| 2,681,869 | 6/1954 | Johnson | 427/229 |
| 3,993,510 | 11/1976 | Bellavin | 148/6.2 |

FOREIGN PATENT DOCUMENTS

| | | | |
|---|---|---|---|
| 2,147,755 | 3/1973 | Fed. Rep. of Germany | 148/6 |
| 2,361,017 | 6/1975 | Fed. Rep. of Germany | 148/6 |

OTHER PUBLICATIONS

Knotek et al., Thin Solid Films, 45, 4–77, pp. 331–332.

Kirk-Othmer, Encyclopedia of Chemical Tech., vol. 18, (1969), pp. 71, 72.

*Primary Examiner*—Ralph S. Kendall

*Attorney, Agent, or Firm*—Cushman, Darby & Cushman

[57] ABSTRACT

There is provided a boriding agent for mass produced parts of ferrous and non-ferrous metals consisting essentially of a boron yielding material, activator, filler and water as a binder and containing in the boriding agent 2 to 8 weight % of pyrogenic silica.

13 Claims, No Drawings

BORIDING AGENT FOR BORIDING MASS PRODUCED PARTS OF FERROUS AND NON-FERROUS METALS

BACKGROUND OF THE INVENTION

The invention is directed to a boriding agent for boriding mass produced parts of ferrous and non-ferrous metals, the boriding agent comprising a boron yielding (or imparting) material, activator, filler and binder.

The boriding of iron materials and non-ferrous metals has been known for a long time as a process for producing wear-preventing coatings. Of the processes described in the literature until now there has only been able to be reduced to practice to a significant extent the powder boriding process. In this process the production part to be treated is packed into a mixture of different materials and subjected to a temperature treatment. As the boriding agent for the most part there is used a mixture which consists of boron carbide as the boron yielding substance, silicon carbide or another filler for regulating the activity and potassium borofluoride as the activator. This mixture furthermore contains in part amorphous carbon and other additives which should increase the activity. It is used as a powder or granulate. The temperature treatment is carried out nearly exclusively in oven furnaces, muffle furnaces or pot furnaces.

Although trouble-free boride coatings are produced by these procedures, they have several severe disadvantages. The packing of the production pieces in the boriding agent and the unpacking are only possible by hand. The area of use of the process from the beginning is limited to the treatment of individual pieces or small series. However, the process is only used reluctantly in practice with large or complicated shaped individual pieces since the consumption of boriding agent is very high in thoses cases. Finally, the partial boriding, i.e., the treatment of separate parts of the production pieces is either impossible or is only possible with considerable difficulty.

For these reasons there has not been a lack of attempts to bring the boriding agent into a brushing, spraying or dipping consistency. Thus the pulverulent boriding mixture is treated with water (e.g., German OS 2147755) whereby a certain binding is effected through the soluble salt-like components of the boriding agent. Also, there has been recommended the use of organic binding agents, as, e.g., acrylic resins, dissolved in acetone (German OS 2361017).

In using pastes the treatment is advantageously carried out under a protective gas (e.g., hydrogen, forming gas) or in a vacuum. The boride coatings therethrough become more homogeneous in regard to their structure and their thickness.

The described boriding pastes until now have had no significant use in practice since they do not fully satisfy the established requirements. Thus, there is the disadvantage that the previously proposed pastes are inclined to separate into their components, i.e., the specifically heavier constituents such as boron carbide and silicon carbon settle to the bottom. Besides, especially with pastes produced with the organic binders and solvents the danger of fire plays an important roll. Finally, with complicated shaped production pieces it is difficult to remove the residual paste without trouble. Also, the use of ultra-sound in this event does not lead to satisfactory results in all cases.

Therefore, it was the problem of the present invention to find a paste for boriding mass produced parts of ferrous and non-ferrous metals which can be applied by brushing, spraying or dipping and which does not have the disadvantages pointed out above. It should be especially stable in storage, non-flammable and easily removed from the production pieces. Furthermore, this paste should be able to be used to make possible a continuous process for boriding a large series of small parts.

SUMMARY OF THE INVENTION

This problem has been solved by using a paste of a boron yielding substance (i.e., a boron donor), a filler, an activator and water as a binder, wherein according to the invention the paste additionally contains 2 to 8 weight % of pyrogenic silica, i.e., silica produced by flame hydrolysis.

As the boron yielding substance there can be employed boron or boron carbide. Also, there can be used ferroboron, boric an hydride or borax. As fillers which simultaneously act to regulate the activity of the paste, which only form monophase coatings of $Fe_2B$, there can be mentioned, for example, aluminum oxide, magnesium oxide or similar inert materials, e.g., graphite. Finally, as an activator there can be used in known manner potassium borofluoride. Other conventional activators such as ammonium, alkali metal and alkaline earth metal chlorides, bromides and fluorides can be used, e.g., ammonium chloride, potassium chloride, sodium chloride, calcium chloride, barium chloride, potassium fluoride, barium fluoride, magnesium fluoride, sodium bromide, sodium fluoride, calcium bromide and sodium borofluoride.

The proportions of the materials other than the silica are not critical and can be those conventionally employed in the art. Thus, the boron yielding substance can be 5 to 45%, the filler 10 to 60%, the activator 2 to 15% and the water 15 to 50% by weight.

The portion of pyrogenic silica can be varied within the given limits, according to the operational requirements. For example, if the paste is applied by dipping, a thicker consistency is selected, i.e., the portion of pyrogenic silica is selected to be relatively high. On the contrary, if the paste is applied to the production piece by spraying, a smaller portion of pyrogenic silica is used. It has proven especially advantageous to use 2 to 5 weight % of pyrogenic silica.

The paste described herein have a series of substantial advantages over the state of the art. They are stable and are not inclined to settle. Besides, they are not combustible. Their consistency is variable inside wide limits. Upon cooling from the boriding temperature at the end of the treatment surprisingly the paste nearly completely falls off or scales off of the production pieces. If with complicatedly shaping production pieces there remain residues, they can be removed without trouble by using warm water, in treating a large series of pieces, in a given case in a washing machine. The basic requirement that in using the pastes well-formed, homogeneous boride coatings are formed is fulfilled in an ideal manner.

The use of these makes the use of a protective gas, e.g., nitrogen or forming gas necessary. In consideration of the substantial saving of the relatively expensive boriding agent, which is produced by the use of the paste process, however, the fact that it is necessarry to use a protective gas industrially is not important.

Because of the described advantages of the paste of the invention it becomes possible to make a continuous boriding process for a large series of parts. By combining an automatic conveyor or chain continuous furnace with a likewise automatic dipping or spraying station there can be treated a large series of suitable parts without difficulty. Besides with the boriding paste of the invention there can also be undertaken a partial boriding.

The composition of the invention can comprise, consist essentially of or consist of the materials set forth and the process can comprise consist essentially of or consist of the steps set forth.

Unless other wise indicated all parts and percentages are by weight.

The advantages of the boriding paste will be further explained in connection with the following examples.

DESCRIPTION OF THE PREFERRED EMBODIMENTS

EXAMPLE 1

There were dipped into a paste of the following composition

| | |
|---|---|
| Boron carbide | 20 weight % |
| Silicon carbide | 40 weight % |
| Potassium borofluoride | 6.7 weight % |
| Water | 30 weight % |
| Pyrogenic silica | 3.3 weight % |

the faces of small pieces measuring 50 × 30 × 20 $mm^3$ of an unalloyed steel Ck 15. These pieces had strong abrasive wear on one face.

The production of the paste was taken up while the powdery components, boron carbide, silicone carbide and potassium borofluoride were first intensively mixed and then stirred into the aqueous suspension of the silica. After the dipping the parts, without drying, were placed on the conveyor of an automatic conveyor furnace, namely, to the surface which is opposite to the one coated with the paste. The furnace was operated with nitrogen as a protective gas. The speed of the conveyor through the furnace was so regulated that the parts after the preheating were exposed for 3 hours to a temperature of 900° C. and were cooled to about 400° C. until the end of the furnace (conveyor end). From the conveyor end the parts were discharged into a crucible where they were allowed to grow cold. No paste residues adhered to the smooth parts present in the crucible.

The boriding fully answered all requirements. On the treated face there was formed a well-formed, homogeneous boride coating having a thickness of 80 to 90μ. Yet it is worth mentioning that in the described process (boriding only the functional surface with paste, continuous furnace under protective gas) 3.3 grams of boriding paste were consumed per part. In comparison in the conventional powder boriding (embedding the entire part in powder) there are required 130 grams of boriding agent per part.

EXAMPLE 2

Automotive parts of steel 34 CrNiMo 6 having the measurements of 55 mm diameter, 30 mm height, an average bore of 13 mm and indentations of the circumference were likewise treated according to this process. The composition of the paste in this case was

| | |
|---|---|
| Amorphous boron | 10 weight % |
| Aluminum oxide | 45 weight % |
| Potassium borofluoride | 6.25 weight % |
| Water | 35 weight % |
| Pyrogenic silica | 3.75 weight % |

The paste was produced in the same manner as in Example 1. Also, the dipping into the boriding paste and the type of heat treatment corresponded to Example 1. However, the conveyor speed was so adjusted that a two hour treatment at 950° C. resulted. At the removal from the conveyor the parts were only cooled to about 850° C. and then were directly discharged into a salt bath that had a temperature of 200° C. Thereby there was obtained a core-hardening directly after the boriding without further heating. Boriding paste residues were not found on the parts but only in the salt bath, from which they could be removed in known manner by removal of the sludge. The thickness of the boride coating was 75 to 95μ, it was unobjectional and uniform. The grain structure of the construction parts corresponded to the martensite structure expected after the heat bath treatment. The amount of boriding paste required was 16 grams per piece, in conventional processes about 210 grams per piece are required.

EXAMPLE 3

Screws (worms) having a length of 1250 mm and a diameter of 60 mm made of steel 42 CrMo 4 for extruding synthetic resins which boriding previously required considerable manual expense and a high consumption of boriding agent was brushed with a boriding paste of the following composition

| | |
|---|---|
| Boron carbide | 25 weight % |
| Silicon carbide | 35 weight % |
| Potassium borofluoride | 6.5 weight % |
| Water | 31 weight % |
| Pyrogenic silica | 2.5 weight % |

Thereby the parts subjected to strongly abrasive wearing such as screw tips, screw ridges and screw flanks, but not the screw foundation were brushed. The treatment took place in a chamber furnace in which there were led in the protecting gas forming gas containing 95% nitrogen and 5% hydrogen. After boriding for five hours at 925° C. there was formed a coating thickness of 140 to 150μ of good quality. According to the conventional packing process per screw there was needed 8.5 kg of boriding agent. In the process of this example there was needed merely 0.95 kg of boriding paste.

What is claimed is:

1. In a boriding agent suitable for boriding mass production parts of ferrous and non-ferrous metals, said boriding agent being a paste comprising a boron yielding material, activator, filler and water, the improvement of also having present in the composition 2 to 8 weight % of pyrogenic silica.

2. The boriding agent according to claim 1 wherein the pyrogenic silica is present in an amount of 2 to 5 weight %.

3. The boriding agent according to claim 2 wherein boron yielding material is amorphous boron or boron carbide, the filler is aluminum oxide, magnesium oxide or silicon carbide and the activator is potassium borofluoride.

4. The process of claim 1 wherein the boriding agent consists essentially of said boron yielding material, activator, filler, water the pyrogenic silica.

5. The process of claim 4 wherein the boron yielding substance is 5 to 45%, the filler 10 to 60%, the activator 2 to 15%, the water 15 to 50% and the pyrogenic silica 2 to 8% by weight of the boriding agent.

6. A process of boriding a ferrous or non-ferrous metal part comprising applying to the metal, the boriding agent of claim 1 and heating until a boride coating is formed on the metal.

7. The process of claim 6 wherein the boriding agent is applied by dipping the metal part into the boriding agent.

8. The process of claim 6 wherein the boriding agent is applied to the part by brushing.

9. The process of claim 6 wherein the boriding agent is applied to the part by spraying.

10. The process of claim 6 wherein the metal is a ferrous metal.

11. The process of claim 6 comprising applying the boriding agent to only a portion less than all of the metal part.

12. The process of claim 6 wherein the boriding agent consists essentially of said boron yielding material, activator, filler, water and pyrogenic silica.

13. The process of claim 12 wherein the boron yielding substance is 5 to 45%, the filler 10 to 60%, the activator 2 to 15%, the water 15 to 50% and the pyrogenic silica 2 to 8% by weight of the boriding agent.

* * * * *